US009098025B2

(12) United States Patent
Masuda

(10) Patent No.: US 9,098,025 B2
(45) Date of Patent: Aug. 4, 2015

(54) IMAGE FORMING APPARATUS WITH INTERLOCKING MECHANISM

(75) Inventor: Takehiro Masuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

(21) Appl. No.: 13/405,009

(22) Filed: Feb. 24, 2012

(65) Prior Publication Data

US 2012/0219324 A1 Aug. 30, 2012

(30) Foreign Application Priority Data

Feb. 25, 2011 (JP) ..... 2011-039535

(51) Int. Cl.

| | |
|---|---|
| ***G03G 15/16*** | (2006.01) |
| ***G03G 15/00*** | (2006.01) |
| ***G03G 15/20*** | (2006.01) |
| ***G03G 21/16*** | (2006.01) |

(52) U.S. Cl.

CPC ..... *G03G 15/2032* (2013.01); *G03G 15/2035* (2013.01); *G03G 21/1633* (2013.01); *G03G 21/1647* (2013.01); *G03G 21/1685* (2013.01)

(58) Field of Classification Search

CPC ..... G03G 15/2032; G03G 15/2035; G03G 21/1633; G03G 21/1638; G03G 21/1647; G03G 2221/1639; G03G 2221/1654; G03G 15/2067; G03G 15/2071

USPC ..... 399/122, 126

See application file for complete search history.

(56) References Cited

U.S. PATENT DOCUMENTS

| | | | | |
|---|---|---|---|---|
| 4,753,543 | A * | 6/1988 | Mochimaru et al. | 400/703 |
| 6,633,733 | B2 | 10/2003 | Mochimaru et al. | |
| 6,904,257 | B2 * | 6/2005 | Tomatsu | 399/328 |
| 7,505,713 | B2 | 3/2009 | Lee et al. | |
| 7,953,348 | B2 | 5/2011 | Chang et al. | |

(Continued)

FOREIGN PATENT DOCUMENTS

| | | | |
|---|---|---|---|
| CN | 1854939 | A | 11/2006 |
| CN | 101145016 | A | 3/2008 |

(Continued)

OTHER PUBLICATIONS

JP Office Action dtd Jan. 15, 2013, JP Appln. 2011-039535, English translation.

(Continued)

*Primary Examiner* — David Gray
*Assistant Examiner* — Tyler Hardman
(74) *Attorney, Agent, or Firm* — Banner & Witcoff, Ltd.

(57) ABSTRACT

An image forming apparatus includes a fixing unit having a heating member that heats a recording medium, a backup member that rotates and contacts the heating member, and a pressure mechanism that supports one of the heating member and the backup member such that the one of the heating member and the backup member moves relative to the other. The apparatus includes a main body including the fixing unit inside, and has a first opening on a downstream side of the fixing unit and a second opening on a side of the main body different from the first opening. Also the apparatus has first and second covers that open and close the first and second openings, respectively, and an interlocking mechanism that causes the pressure mechanism to move the one of the heating member and the backup member in conjunction with movement of the first cover and the second cover.

20 Claims, 11 Drawing Sheets

(56) References Cited

U.S. PATENT DOCUMENTS

| | | | | |
|---|---|---|---|---|
| 7,974,553 | B2 | 7/2011 | Matsuo et al. | |
| 8,213,832 | B2 | 7/2012 | Matsuo et al. | |
| 8,270,874 | B2 | 9/2012 | Iwase et al. | |
| 2002/0051646 | A1 | 5/2002 | Mochimaru et al. | |
| 2003/0118382 | A1 | 6/2003 | Tomatsu | |
| 2006/0013614 | A1* | 1/2006 | Ikeda | 399/122 |
| 2006/0239715 | A1 | 10/2006 | Lee et al. | |
| 2007/0019977 | A1* | 1/2007 | Sawamura et al. | 399/67 |
| 2008/0069589 | A1* | 3/2008 | Chang et al. | 399/122 |
| 2009/0208237 | A1 | 8/2009 | Yasuda | |
| 2010/0028044 | A1* | 2/2010 | Matsuo et al. | 399/122 |
| 2010/0080619 | A1* | 4/2010 | Kawanami | 399/112 |
| 2010/0254728 | A1* | 10/2010 | Iwase et al. | 399/122 |
| 2011/0222928 | A1 | 9/2011 | Matsuo et al. | |
| 2012/0082478 | A1* | 4/2012 | Wang | 399/110 |

FOREIGN PATENT DOCUMENTS

| | | | | |
|---|---|---|---|---|
| JP | 04-042280 | A | | 2/1992 |
| JP | H06-337612 | A | | 12/1994 |
| JP | 08185076 | A | * | 7/1996 |
| JP | HEI 08-185076 | A | | 7/1996 |
| JP | HEI 08-195076 | | | 7/1996 |
| JP | H10-177314 | A | | 6/1998 |
| JP | 2002-148992 | A | | 5/2002 |
| JP | 2002-202638 | A | | 7/2002 |
| JP | 2002-296948 | A | | 10/2002 |
| JP | 2002296948 | A | * | 10/2002 |
| JP | 2003-015459 | A | | 1/2003 |
| JP | 2003-186337 | A | | 7/2003 |
| JP | 2007-279298 | A | | 10/2007 |
| JP | 2008-287242 | A | | 11/2008 |
| JP | 2009-180917 | A | | 8/2009 |
| JP | 2010-032833 | A | | 2/2010 |
| JP | 2010-152032 | A | | 7/2010 |

OTHER PUBLICATIONS

CN First Office Action mailed Jan. 29, 2014, CN Appln. 201210044295.3, English translation.

European Search Report for application No. 12156167.4 mailed Sep. 17, 2013.

Office Action issued in corresponding Chinese Application No. 201210044295.3 dated Sep. 29, 2014.

* cited by examiner

IMAGE FORMING APPARATUS WITH INTERLOCKING MECHANISM

CROSS REFERENCE TO RELATED APPLICATION

This application claims priority from Japanese Patent Application No. 2011-039535, filed on Feb. 25, 2011, the entire subject matter of which is incorporated herein by reference.

FIELD

Aspects of the disclosure relate to an image forming apparatus including a fixing unit configured to thermally fix a developer image transferred onto a recording medium.

BACKGROUND

A known electrophotographic image forming apparatus including a fixing unit may include a rear cover and a top cover. The rear cover is configured to open and close an opening formed on a downstream side of the fixing unit disposed in a main body in a medium feeding direction where a recording medium is fed. The top cover is configured to open and close an opening formed in an upper portion of the main body.

The fixing unit may include a heat roller and a pressure roller that contacts the heat roller with pressure. The image forming apparatus further includes an interlocking mechanism configured to operate in connection with movement of the rear cover or the top cover such that the heat roller and the pressure roller are separated from each other. When a recording medium is jammed in the fixing unit, a user can pull out the jammed recording medium easily only by opening the rear cover or the top cover.

In the above art however, when a thicker recording medium, for example, is printed using a straight-through path in which a printed medium is ejected onto the rear cover being opened, thermal image fixing may not be sufficiently performed because the heat roller and the pressure roller are separated from each other.

SUMMARY

Illustrative aspects of the disclosure provide an image forming apparatus configured to perform thermal image fixing to a sufficient degree in a straight-through path and facilitate clearing a jammed medium in the straight-through path.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. Aspects of the disclosure are applied to an image forming apparatus, e.g. a laser printer 1.

A general structure of the laser printer 1 will be described with reference to FIG. 1.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

Figure 1:
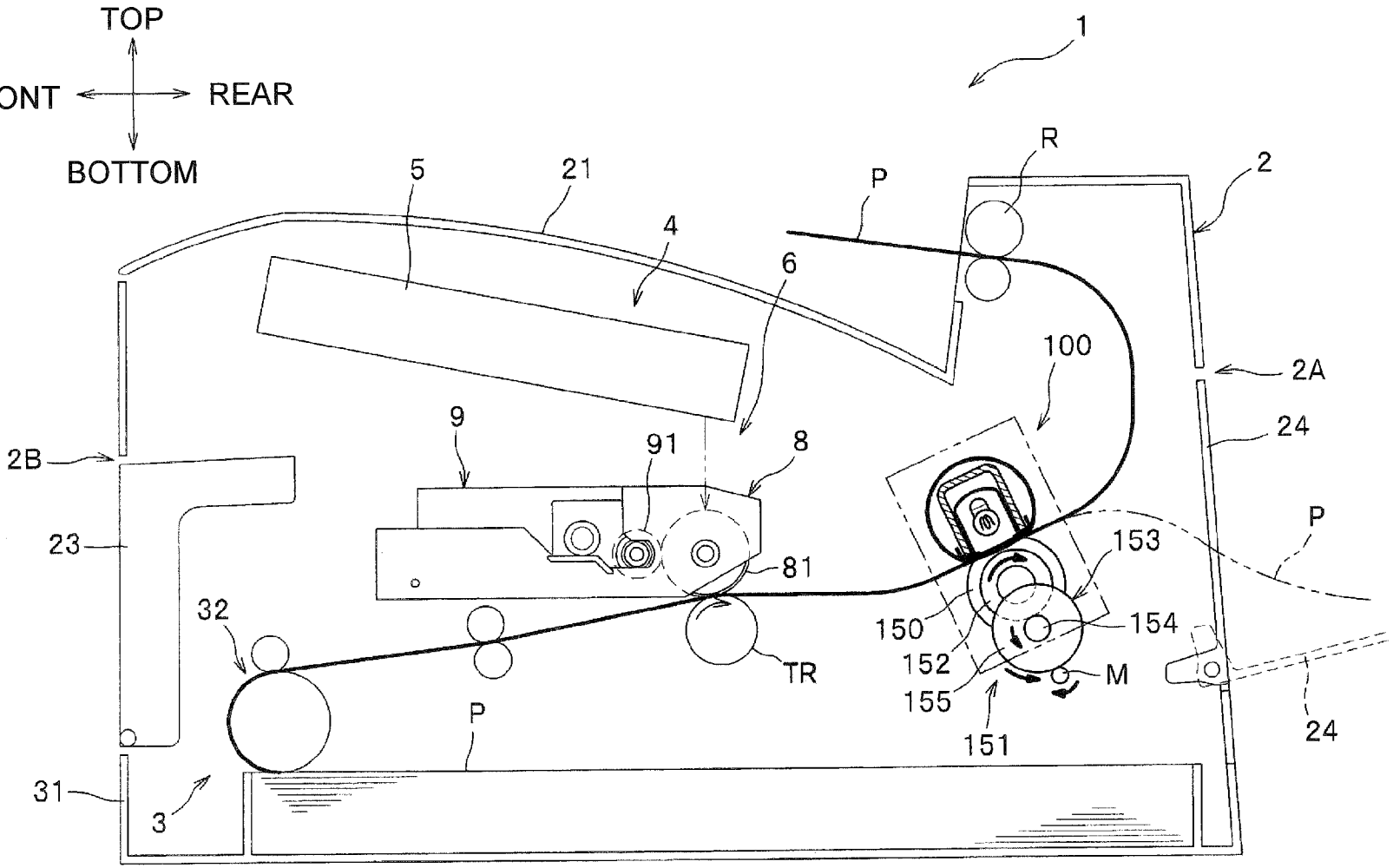
FIG. 1 is a sectional view of an illustrative image forming apparatus, e.g. a laser printer, according to an illustrative embodiment.
Figure 7:
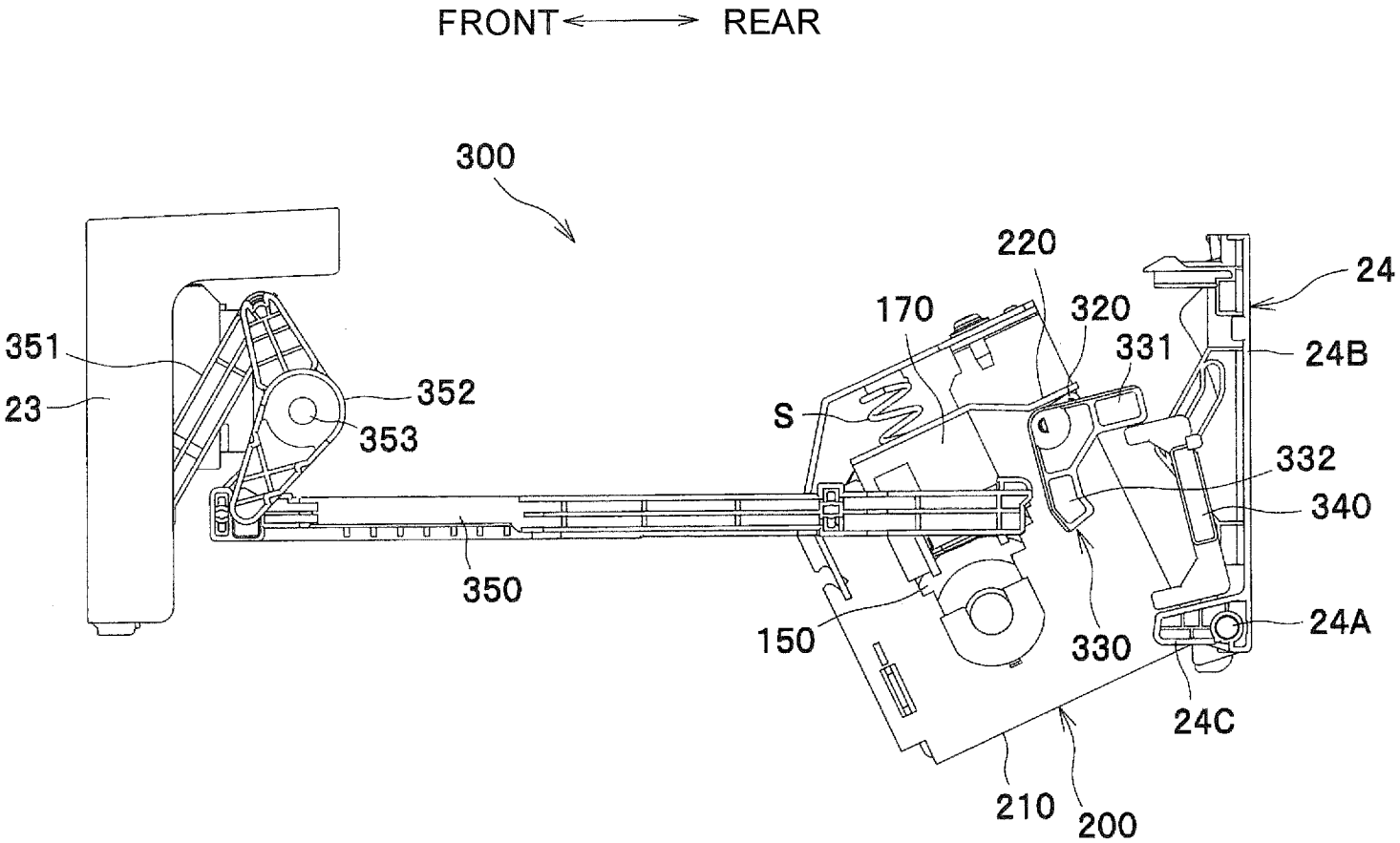
FIG. 7 illustrates an interlocking mechanism when a front cover and a rear cover are closed.

As shown in FIG. 1, the laser printer 1 includes, a main body 2, a feeder portion 3, an image forming unit 4, and interlocking mechanism 300 (FIG. 7). The feeder portion 3 is configured to feed a recording medium (e.g., plain paper, post cards, transparency sheets, and the like) hereinafter referred to as a sheet P, to the image forming unit 4. The image forming unit 4 is configured to form an image on the sheet P.

The feeder portion 3 includes a sheet supply tray 31 and a sheet supply mechanism 32. The sheet supply tray 31 may be detachably disposed in a lower portion of the main body 2 and configured to receive a stack of sheets P therein. The sheet supply mechanism 32 is configured to feed a sheet P from the sheet supply tray 31 to the image forming unit 4.

The image forming unit 4 includes a scanner unit 5, a process unit 6, a transfer roller TR and a fixing unit 100.

The scanner unit 5 may be disposed in an upper portion in the main body 2 and include a laser emitting portion, a polygon mirror, lens, and reflecting mirror, which are not shown. The scanner unit 5 is configured to direct a laser beam to a surface of a photosensitive drum 81 by high speed scanning.

The process unit 6 may be detachably attached to the main body 2, and disposed between a front cover 23 and the fixing unit 100. The process unit 6 includes a drum cartridge 8 including the photosensitive drum 81 and a developing cartridge 9 including a developing roller 91 and toner.

In the process unit 6, the surface of the photosensitive drum 81, which rotates, is uniformly charged by a charger, not shown, and then exposed to the laser beam from the scanner unit 5 by high speed scanning The surface potential in the exposed portion becomes lower and an electrostatic latent image based on image data is formed on the surface of the photosensitive drum 81.

The developing roller 91, which rotates, supplies toner of the developing cartridge 9 onto the electrostatic latent image on the surface of the photosensitive drum 81, so that a toner image is formed on the surface of the photosensitive drum 81. The sheet P goes in between the photosensitive drum 81 and the transfer roller TR, such that the toner image carried on the surface of the photosensitive drum 81 is transferred onto the sheet P.

The fixing unit 100 is disposed on a downstream side of the process unit 6 in a sheet feeding direction where a sheet P is fed. The sheet P having the toner image transferred thereto passes through the fixing unit 100 such that the toner image is thermally fixed to the sheet P. The sheet P is fed to an ejection roller R disposed on a downstream side of the fixing unit 100 and ejected to an output tray 21 by the ejection roller R.

A rear wall of the main body 2, which is located on the downstream side of the fixing unit 100, contains a first opening 2A, and a front wall of the main body 2 contains a second opening 2B. The main body 2 supports a first cover, e.g. a rear cover 24, and a second cover, e.g. a front cover 23. The rear cover 24 is rotatable to open and close the first opening 2A and the front cover 23 is rotatable to open and close the second opening 2B.

The fixing unit 100 will be described.

Figure 2:
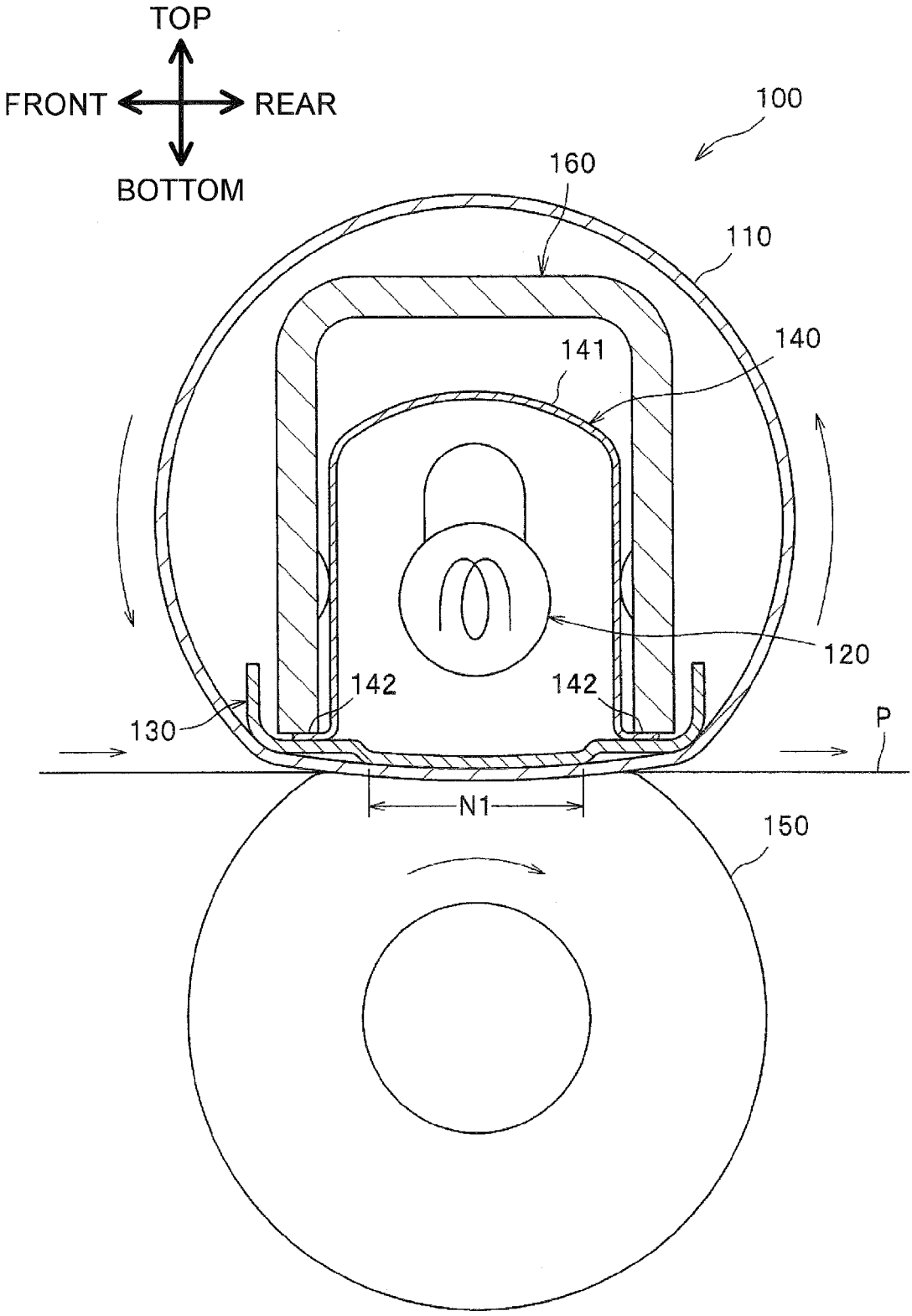
FIG. 2 schematically illustrates a general structure of a fixing unit.
Figure 5:
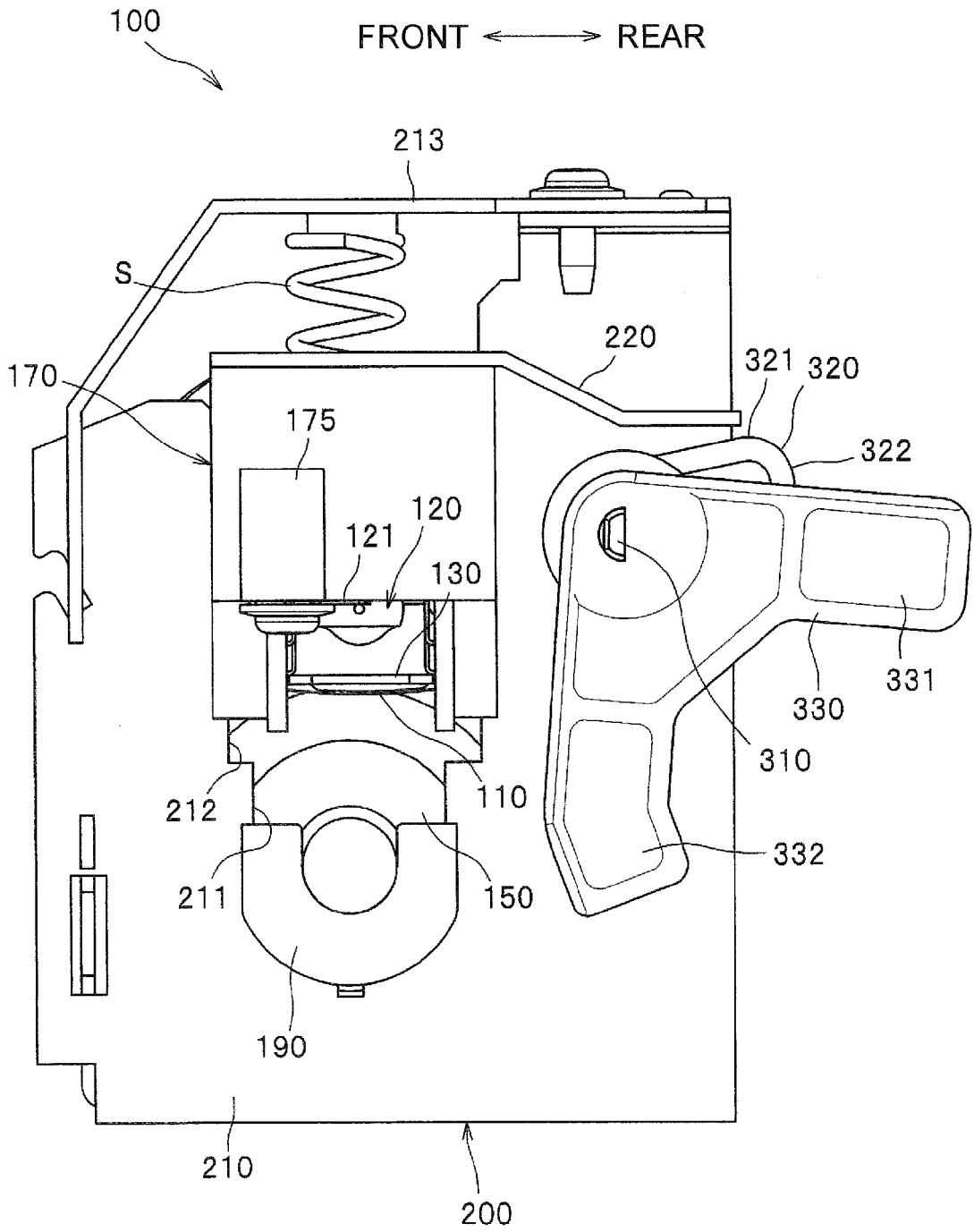
FIG. 5 is a right side view of the fixing unit.

As shown in FIG. 2, the fixing unit 100 may be configured to be attached to and removed from the main body 2, and includes a fixing film 110, a halogen lamp 120, a heating element such as a nip plate 130, a reflection plate 140, a backup element such as a pressure roller 150, a stay 160, and a pressure mechanism 200 (refer to FIG. 5).

The fixing film 110 may be an endless or tubular film that is heat resistant and flexible. Each end of the fixing film 110 is guided by a guide member 170 such that the fixing film 110 rotates.

The halogen lamp 120 is a known heating element and configured to apply heat to the nip plate 130 and the fixing film 110 to heat toner on the sheet P. The halogen lamp 120 can be disposed inside the fixing film 110 and spaced away from the fixing film 110 and the nip plate 130.

The nip plate 130 is configured to receive radiant heat from the halogen lamp 120 and is disposed to slidingly contact an inner surface of the tubular fixing film 110. The nip plate 130 transmits the radiant heat received from the halogen lamp 120 to toner on the sheet P via the fixing film 110.

The nip plate 130 may be formed of, for example, an aluminum plate having higher thermal conductivity than that of the stay 160 made of steel. The upper surface of the nip plate 130 may be painted black or covered with a heat-absorbing member, so that nip plate 130 can effectively absorb the radiant heat from the halogen lamp 120.

The reflection plate 140 is configured to reflect the radiant heat discharged (mainly in the front-rear direction or upward) from the halogen lamp 120 toward the upper surface of the nip plate 130. The reflection plate 140 is spaced a predetermined distance away from the halogen lamp 120 so as to enclose the halogen lamp 120 inside the fixing film 110.

As the reflection plate 140 allows the nip plate 130 to collect the radiant heat from the halogen lamp 120, the radiant heat can be effectively used so as to heat the nip plate 130 and the fixing film 110 quickly.

The reflection plate 140 may be U-shaped as viewed in cross section and made of a material, e.g. aluminum, having high reflectivity of infrared radiation and far-infrared radiation. More specifically, the reflection plate 140 may include, as illustrated in FIG. 2, a reflection portion 141 having a curved shape (U-shaped as viewed in cross section) and flange portions 142 extending outside in the front-rear direction from both ends of the reflection portion 141. To improve the heat reflectivity, the reflection plate 140 may be formed of an aluminum plate polished to a mirror-smooth state.

The pressure roller 150 is disposed below the nip plate 130 and is configured to rotate while pressing the nip plate 130. The nip plate 130 and the pressure roller 150 sandwich the fixing film 110 therebetween such that a nip portion N1 is formed between the fixing film 110 and the pressure roller 150.

As shown in FIG. 1, the pressure roller 150 is connected via a transmission mechanism 151 to a motor M (a drive source) disposed in the main body 2 so as to receive a drive force from the motor M and rotate. When the pressure roller 150 rotates, the fixing film 110 is rotated by friction between the pressure roller 150 and the fixing film 110.

The transmission mechanism 151 includes a drive gear 152 and a one-way clutch 153. The drive gear 152 is fixed to a rotation shaft of the pressure roller 150. The one-way clutch 153 includes a small-diameter gear 154 engageable with the drive gear 152, a large-diameter gear 155 engageable with the motor M, and a clutch mechanism (not shown) disposed between the small-diameter gear 154 and the large-diameter gear 155.

The clutch mechanism may be configured such that, when the motor M drives, the large-diameter gear 155 rotates counterclockwise, a drive force of the large-diameter gear 155 is transmitted to the small-diameter gear 154, and the small-diameter gear 154 rotates counterclockwise. With this configuration, the pressure roller 150 rotates clockwise to feed the sheet P sandwiched by the pressure roller 150 and the nip plate 130.

The clutch mechanism may also be configured such that, when the large-diameter gear 155 rotates clockwise relative to the small-diameter gear 154, the large-diameter gear 155 slides on the small-diameter gear 154 and runs idle. Thus, when the small-diameter gear 154 rotates counterclockwise relative to the large-diameter gear 155, the small-diameter gear 154 runs idle. With this configuration, when the sheet P sandwiched between the nip plate 130 and the pressure roller 150 is pulled toward the first opening 2A (toward the sheet feeding direction), the pressure roller 150 rotates clockwise, the small-diameter gear 154 rotates counterclockwise and runs idle relative to the large-diameter gear 155. This rotation of the small-diameter gear 154 is not transmitted to the motor M, which facilitates rotating the pressure roller 150 and pulling the sheet P.

As shown in FIG. 2, the stay 160 supports both ends of the nip plate 130 in the front-rear direction via the flange portions 142 of the reflection plate 140 to provide rigidity in the nip plate 130. The stay 160 has a shape formed along a contour of the reflection plate 140 (or is U-shaped in cross section) so as to cover the reflection plate 140. The stay 160 is formed by bending a steel sheet having relatively high rigidity in substantially a U shape in cross section.

Figure 3:
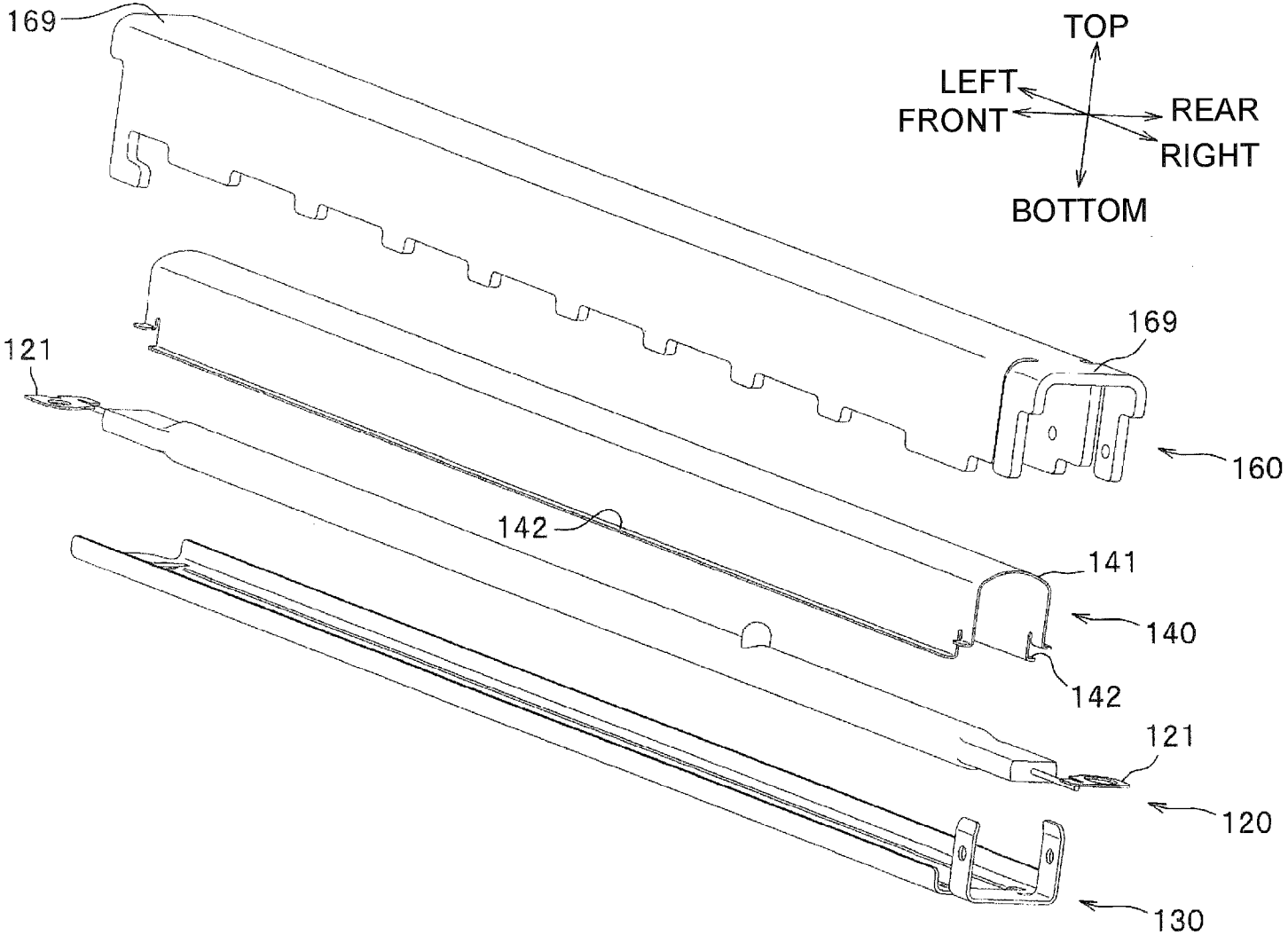
FIG. 3 is a perspective view of a halogen lamp, a nip plate, a reflection plate, and a stay.

As shown in FIG. 3, the stay 160 is formed with supported portions 169 projecting outward from the right and left of the stay 160 in an upper portion thereof. The supported portions 169 are supported by the guide members 170.

Figure 4A:
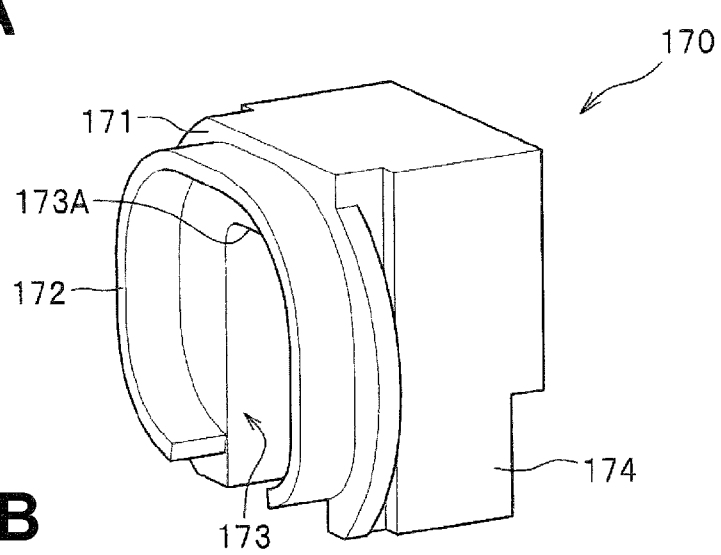
FIG. 4A is a perspective view, looking from above, of a guide member.

The guide members 170 are made of an insulation material, e.g., a resin, disposed on both ends of the fixing film 110 respectively, and configured to restrict movement of the fixing film 110 in the left-right direction. Specifically, as shown in FIG. 4A, the guide member 170 includes a restriction surface 171 that restricts the movement of the fixing film 170 in the left-right direction, a restriction portion 172 that restricts deformation of the fixing film 110 inward radially, and a holding recess portion 173 that holds each end of the stay 160.

The restriction portion 172 is a rib projecting inward in the left-right direction from the restriction surface 171 and has a C-shape with an opening facing downward. The restriction portion 172 is inserted inside the fixing film 110 to restrict deformation of the fixing film 110 inward radially. The opening of the restriction portion 172 facing downward is used for inserting the stay 160 into the holding recess portion 173.

Figure 4B:
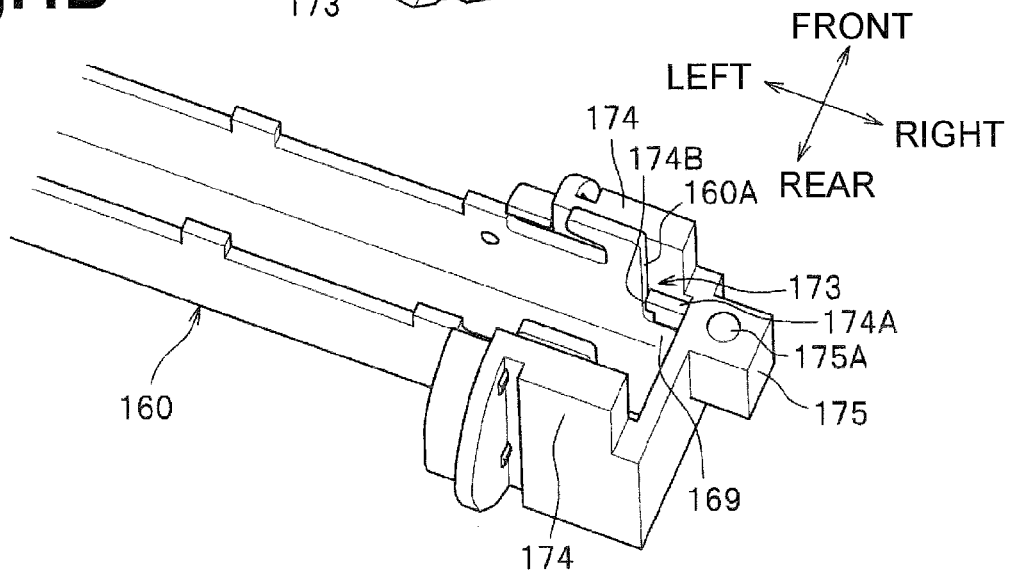
FIG. 4B is a perspective view, looking from below, of the guide member attached to the stay.
Figure 4C:
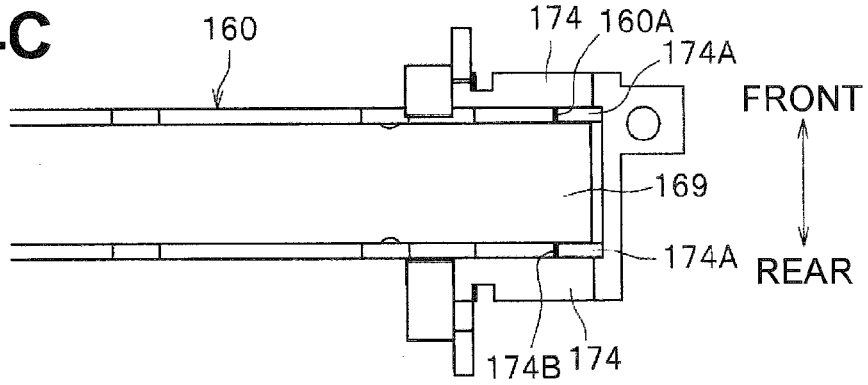
FIG. 4C is a bottom view of the guide member attached to the stay.

The holding recess portion 173 is a groove that opens downward and through in the left-right direction. As shown in FIGS. 4B and 4C, the holding recess portion 173 is defined by a pair of sidewalls 174 opposing each other in the front-rear direction. The sidewalls 174 are formed with engaging projections 174A, respectively. The engaging projections 174A project inward from the corresponding sidewalls 17 at locations away from a bottom surface 173A (FIG. 4A) of the holding recess portion 173.

As shown in FIG. 4B, when the supported portion 169 of the stay 160 is inserted between the bottom surface 173A of the holding recess portion 173 and the engaging projections 174A, the vertical movement of the supported portion 169 is restricted by the bottom surface 173A of the holding recess portion 173 and the engaging projections 174A. Thus, the vertical displacement of the stay 160 relative to the guide member 170 can be restricted.

In the left-right direction, inward-facing surfaces 174B of the corresponding engaging projections 174A are configured to contact outer edges 160A of the stay 160. With this configuration, even when the stay 160 is subjected to vibration caused by the drive of the fixing unit 100, the position of the stay 160 in the left-right direction can be restricted as the engaging projections 174A contact the stay 160. As a result, the displacement of the stay 160 relative to the guide member 170 can be restricted in the left-right direction.

The stay 160 is sandwiched between the sidewalls 174 defining the holding recess portion 173 such that the displacement of the stay 160 can be restricted in the front-rear direction. Thus, as the stay 160 is supported by the guide member 170 as described above, the nip plate 130 is supported by the guide member 170 together with the stay 160. The guide member 170 is formed with a fixing portion 175 so that the fixing portion 175 projects outward in the left-right direction. The fixing portion 175 is configured to fix a terminal 121 (FIG. 3) disposed on each end of the halogen lamp 120.

Figure 6:
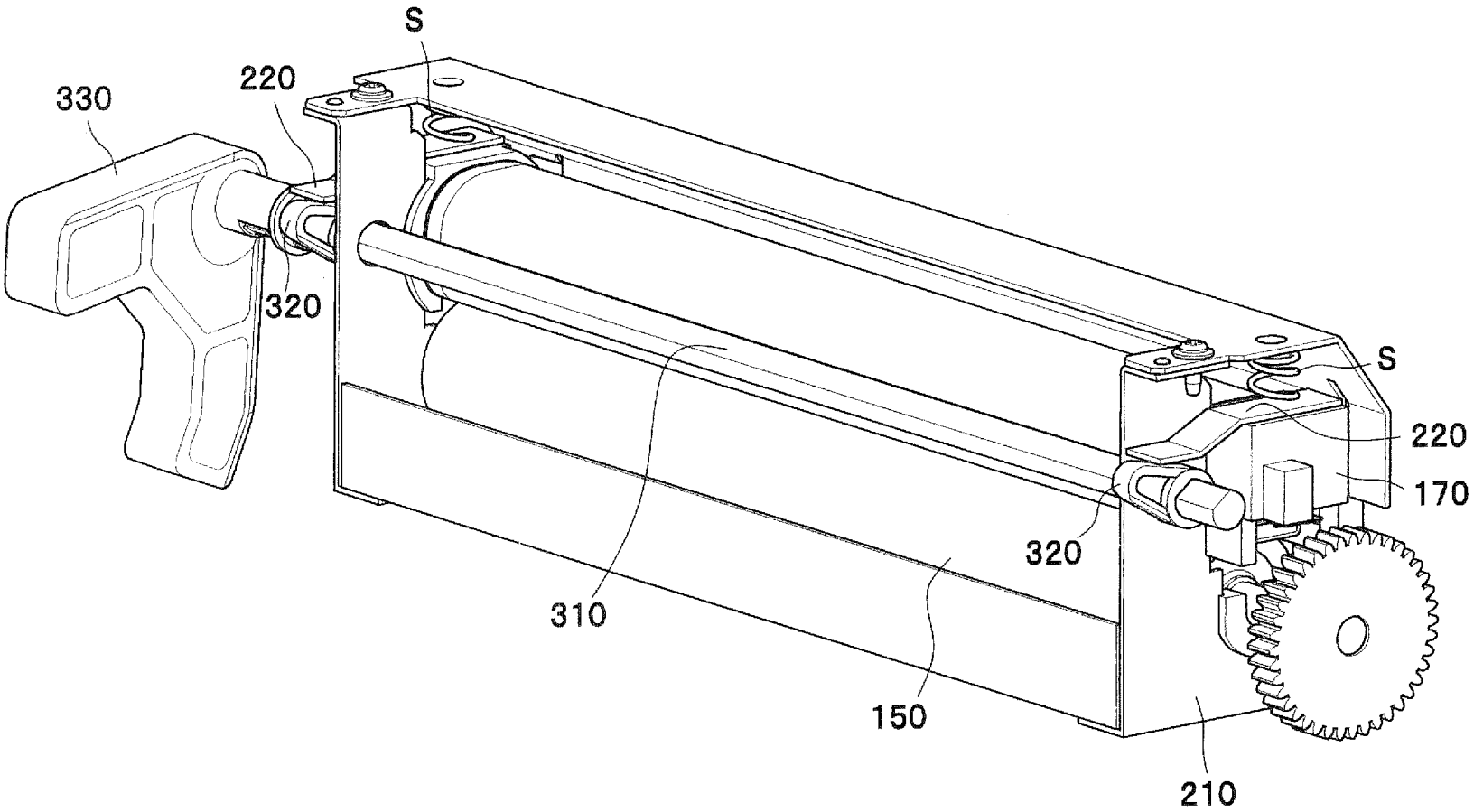
FIG. 6 is a perspective view, looking obliquely from the rear of and above the fixing unit.

As shown in FIGS. 5 and 6, the pressure mechanism 200 includes a fixing frame 210, the guide members 170, support plates 220, and coil springs S, which are disposed on left and right sides of the fixing frame 210.

The fixing frame 210 supports the pressure roller 150 rotatably and the guide members 170, which support the nip plate 130, movably relative to the pressure roller 150. Specifically, each of left and right sidewalls of the fixing frame 210 is formed with a shaft-support groove 211 and a support groove 212. The shaft-support groove 211 is configured to support a bearing 190 of the pressure roller 150. The support groove 212 is configured to support the guide member 170 such that the guide member 170 is movable vertically.

Each support plate 220 is fixed to an upper surface of a corresponding one of the guide members 170 and extends rearward (toward a release cam 320, described later) while bending.

Each coil spring S is disposed between the support plate 220 and an upper frame 213 fixed to the top of the fixing frame 210 to urge the support plate 220 and the guide member 170 downward (toward the pressure roller 150) at all times.

Figure 10:
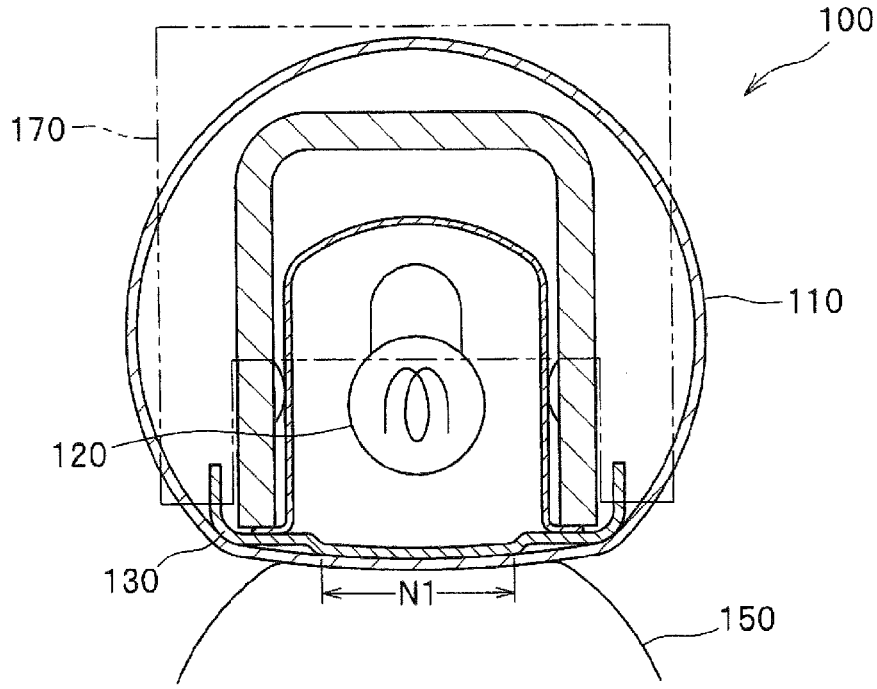
FIG. 10 illustrates the nip plate located in a first position.

In the pressure mechanism 200 structured in this manner, the nip plate 130 is urged toward the pressure roller 150 such that an appropriate nip pressure is applied between the nip plate 130 and the pressure roller 150 during printing control. In normal printing, the nip plate 130 is located in a first position (shown in FIG. 10) and a nip portion N1 is formed between the nip plate 130 and the pressure roller 150.

The fixing frame 210 of the fixing unit 100 rotatably supports a shaft 310, which is a part of an interlocking mechanism 300.

The interlocking mechanism 300 will be described.

As shown in FIGS. 6 and 7, the interlocking mechanism 300 is disposed in the main body 2, and is configured to cause the pressure mechanism 200 to move the guide members 170 (supporting the nip plate 130) in conjunction with movement of the front cover 23 and the rear cover 24. The interlocking mechanism 300 includes the shaft 310, a first cam such as a pair of release cams 320, an L-shaped arm 330, a first slide member 340, a second cam 24C, a second slide member 350, a first link 351, and a second link 352.

The shaft 310 extends in the left-right direction, passes through the left and right sidewalls of the fixing frame 210, such that the shaft 310 is rotatably supported by the fixing frame 210.

The release cams 320 are fixed to left and right ends of the shaft 310 and project outward from the shaft 310 in a radial direction thereof. A circumferential surface of each cam 320 includes a first support portion 321 disposed at a position away from the shaft 310 and a second support portion 322 disposed at a position further away from the shaft 310 than the first support portion 321 (refer to FIG. 5). The release cams 320 are configured to engage the support plate 220 and move the support plate 320 vertically (or act on the pressure mechanism 200) when the shaft 310 rotates.

The L-shape arm 330 is fixed to the right end of the shaft 310. The L-shape arm 330 includes a first arm 331 extending rearward (toward the rear cover 24) from the shaft 310 and a second arm 332 extending downward from the shaft 310 and then diagonally downward (toward the rear cover 24) with the front cover 23 and the rear cover 24 being closed.

The L-shape arm 330 is fixed to the shaft 310 together with the release cams 320. Thus, by rotating the L-shape arm 330, the support plates 220 can be moved vertically via the release cams 320.

Figure 8:
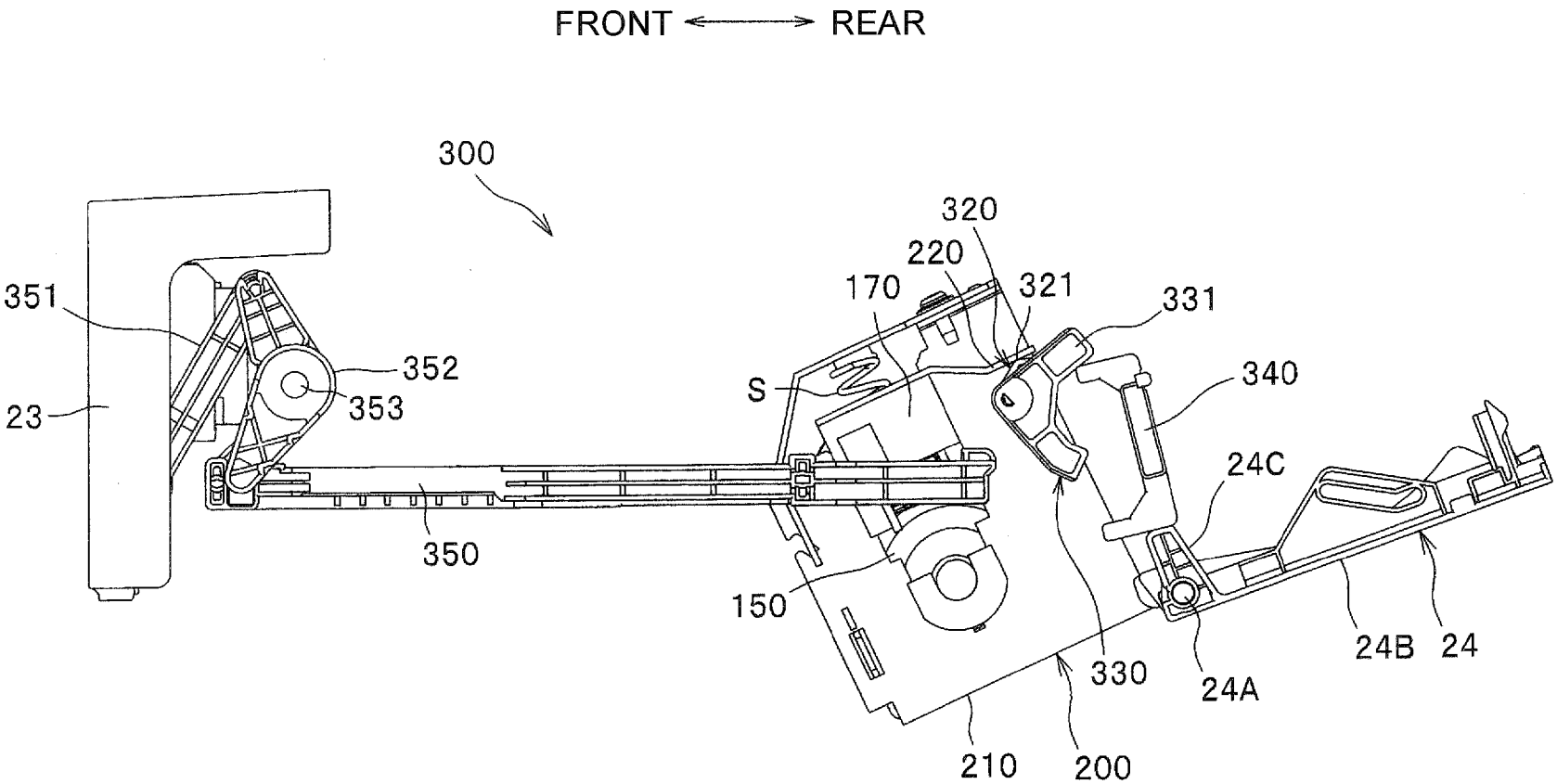
FIG. 8 illustrates the interlocking mechanism when the rear cover is opened.

Specifically, as shown in FIG. 8, when the L-shape arm 330 rotates counterclockwise, the release cams 320 also rotate counterclockwise and press the support plates 220 upward. With this movement, the left and right guide members 170 move upward against urging forces of the coil springs S. When the L-shape arm 330 returns to its original position from this state, as shown in FIG. 5, the release cams 320 are disengaged from the support plates 220, and the guide members 170 move downward due to the urging forces of the coil springs S.

When the guide members 170 are caused to move vertically relative to the fixing frame 210 by rotating the L-shape arm 330 in this manner, the nip plate 130 held by the guide members 170 moves vertically relative to the pressure roller 150 supported by the fixing frame 210. Thus, the nip pressure applied between the nip plate 130 and the pressure roller 150 can be changed.

As shown in FIG. 7, the first slide member 340 is a bar extending substantially vertically, disposed between the second cam 24C and the first arm 331, and supported by the main body 2 so as to be slidable in its longitudinal direction.

The second cam 24C is disposed at a lower end of the rear cover 24 and formed extending from a rotation center 24A of the rear cover 24 in a direction perpendicular to a cover body 24B. The second cam 24C is configured to convert a rotating movement of the rear cover 24 to a sliding movement of the first slide member 340.

As shown in FIG. 8, when the rear cover 24 is opened, a lower end of the first slide member 340 engages the second cam 24C and the first slide member 340 is pressed upward. When the rear cover 24 is closed, the first slide member 340 is disengaged from the second arm 24C, the urging force of the coil spring S causes the first arm 331 and the first slide member 340 to move downward, and the first slide member 340 returns to its original position.

Figure 11:
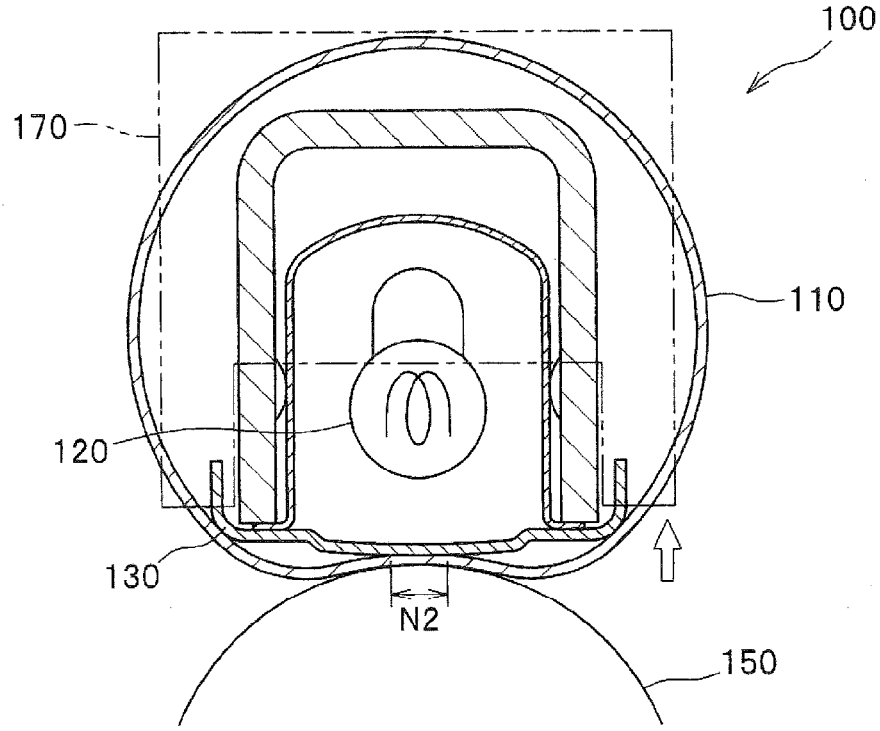
FIG. 11 illustrates the nip plate located in a second position.

The first slide member 340 is in its topmost position when the rear cover 24 is fully opened (as shown in FIG. 8). At this time, the first support portion 321 of the release cam 320 engages the support plate 220. As shown in FIG. 11, the nip plate 130 is in a second position further upward away from the pressure roller than in the first position, and forms a nip portion N2 having a narrower width than the nip portion N1, with the pressure roller 150. In other words, the interlocking mechanism 300 is configured to operate in conjunction with an opening movement of the rear cover 24 and to press the nip plate 130 to the pressure roller 150 in the second position further away from the pressure roller 150 than in the first position.

As shown in FIG. 8, with the rear cover 24 being fully opened, the first slide member 340 is configured such that a direction pointing from an engage portion of the second cam 24C with the first slide member 340 to the rotation center 24A of the second cam 24C is parallel to a direction in which the first slide member 340 moves. With this configuration, when the rear cover 24 is fully opened, a force applied by the coil spring S of the pressure mechanism 200 via the first slide member 340 to the second cam 24C is directed to the rotation center 24A of the rear cover 24, which can prevent the rear cover 24 from being closed by the urging force of the coil spring S.

As shown in FIG. 7, the second slide member 350 is a bar extending in the front-rear direction, and is disposed between the front cover 23 and the second arm 332, and its front end is connected to the front cover 23 via the first link 351 and the second link 352.

The first link 351 has a length and is rotatably connected to the front cover 23.

The second link 352 is rotatably supported by the main body 2 between the first link 351 and the second slide member 350, and rotatably connected to the first link 351 and the second slide member 350. Specifically, the second link 352 includes a link shaft 353 that rotatably supports the second link 352, in its center, an arm portion extending upward from the link shaft 353 diagonally to the front and connected to the first link 351, and an arm portion extending downward from the link shaft 351 diagonally to the front and connected to the second slide member 350.

Figure 9:
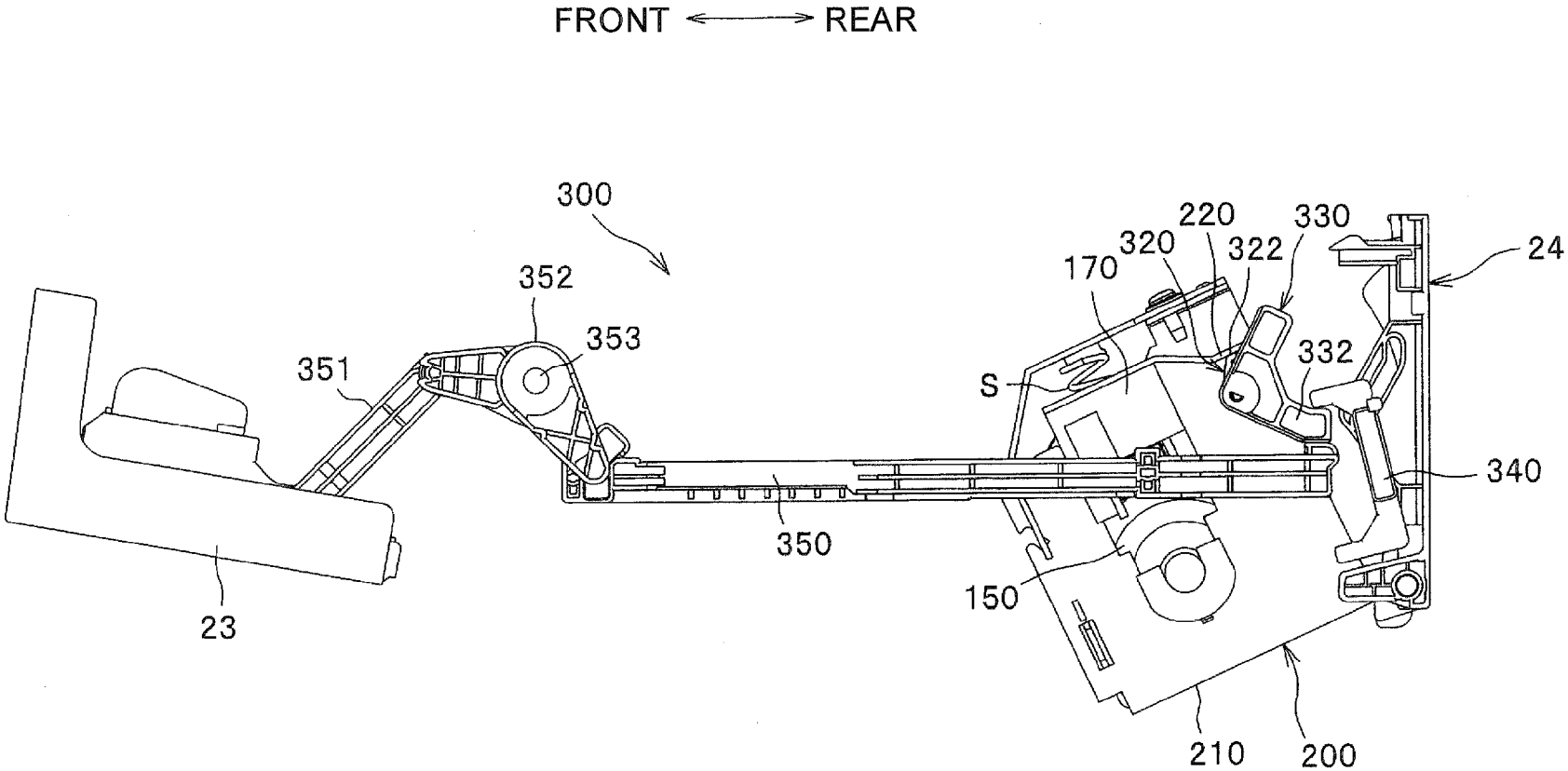
FIG. 9 illustrates the interlocking mechanism when the front cover is opened.

As shown in FIG. 9, when the front cover 23 is opened, the first link 351 moves to the front and the second link 352 rotates counterclockwise accordingly. Thus, the second slide member 350 is pressed rearward. On the other hand, when the front cover 23 is closed, the first link 351 moves to the rear and the second link 352 rotates clockwise accordingly. Thus, the second slide member 350 moves to the front.

The second slide member 350 is configured to transmit a force from the front cover 23 to the second arm 332. When the front cover 23 is opened, the second slide member 350 moves to the rear and its rear end presses the second arm 332 to the rear. Thus, the L-shape arm 330 rotates counterclockwise. When the front cover 23 is closed from this state, the second slide member 350 is disengaged from the second arm 332, and the urging force of the coil spring S causes the L-shape arm 330 to return to its original position.

Figure 12:
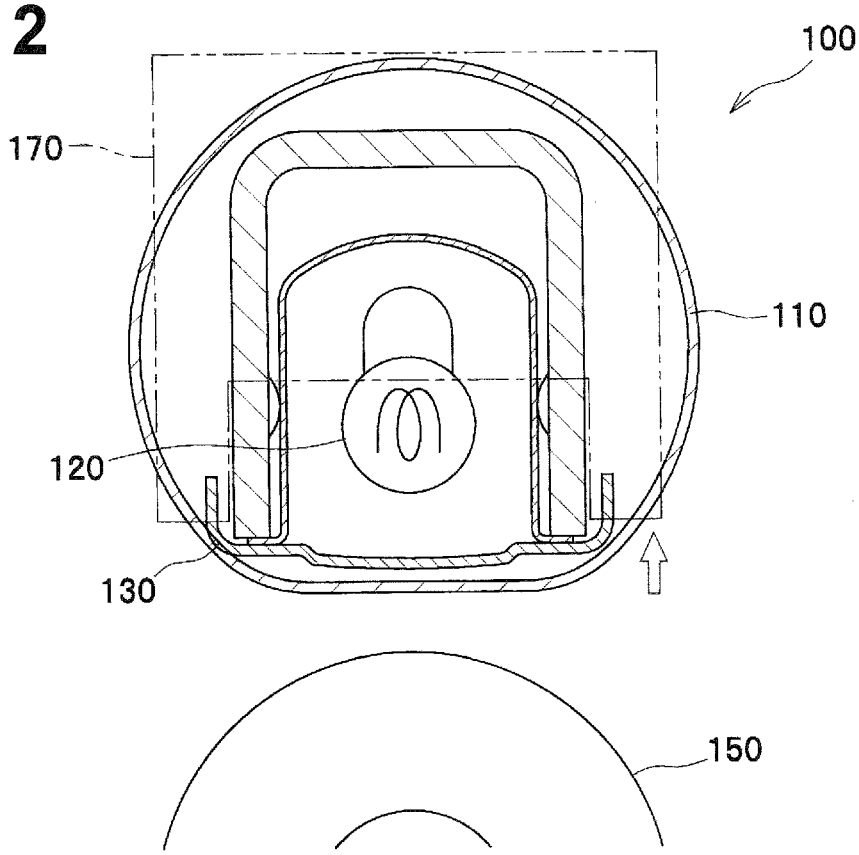
FIG. 12 illustrates the nip plate located in a third position.

The second slide member 350 is in its rearmost position when the front cover 23 is fully opened (to a position shown in FIG. 9). At this time, the second support portion 322 of the release cam 320 engages the support plate 220. As shown in FIG. 12, the nip plate 130 is located in a third position where it is spaced apart from the pressure roller 150, and no nip pressure is applied between the nip plate 130 and the pressure roller 150. In other words, the interlocking mechanism 300 is configured to operate in conjunction with an opening movement of the front cover 23 and to locate the nip plate 130 in the third position where the nip plate 130 is further away from the pressure roller 150 than in the second position.

In addition, the second slide member 350 has a length, in the front-rear direction, such that the second arm 332 sits atop the second slide member 350 in a state where the front cover 23 is fully opened. Thus, when the front cover 23 is fully opened, a force applied from the coil spring S of the pressure mechanism 200 via the second arm 332 to the second slide member 350 is directed in a direction perpendicular to a direction where the second slide member 350 moves, which can prevent the front cover 23 from being closed by the urging force of the coil spring S.

The following will describe how the laser printer 1 structured above can be used.

In normal printing, the laser printer 1 is used with the front cover 23 and the rear cover 24 being closed (in a state shown in FIG. 7). At this time, the nip plate 130 is located in the first position and the sheet P having toner images passes between the pressure roller 150 and the heated fixing film 110 (or passes through the nip portion N1), so that the toner images are thermally fixed to the sheet P.

When a thick medium, e.g., an envelope, is printed, the laser printer 1 is used with the rear cover 24 being opened as shown in FIG. 8. At this time, the nip plate 130 is located in the second position with the nip portion N2, which is narrower than the nip portion N1 for normal printing. Thus, the thick medium such as an envelope can be nipped and thermally fixed under an appropriate pressure. The sheet P having passed through the fixing unit 100 is ejected from the first opening 2A, in a straight-through path, to the rear cover 24, without being fed to the ejection roller R.

The sheet P may be jammed in the fixing unit 100 during printing with the straight-through path. Even if the sheet P jammed between the nip plate 130 and the pressure roller 150 is pulled out from the rear side where the rear cover 24 is provided, the transmission mechanism 151 interrupts transmission of the rotation of the pressure roller 150 to the motor M. Thus, the jammed sheet S can be smoothly pulled out.

The sheet S may be jammed in the fixing unit 100 during printing with the front cover 23 and the rear cover 24 being closed. In this case, the front cover 23 may be opened such that the process unit 6 is removed from the main body 2. At this time, the nip plate 130 is located in the third position spaced apart from the pressure roller 150, and the sheet P is not nipped by the nip plate 130 and the pressure roller 150. Thus, the sheet P can be smoothly pulled out from the front side.

In this embodiment, the following advantages may be obtained.

When the rear cover 24 is opened, the nip plate 130 remains in contact with the pressure roller 150 under pressure. Thus, during the thick medium printing, the thick medium can be thermally fixed under an appropriate pressure and ejected in the straight-through path. As the nip plate 130 is located in the second position where the nip plate 130 is separated from the pressure roller 150 further than in the first position, the pressure between the nip plate 130 and the pressure roller 150 is reduced. When the sheet S is jammed between the nip plate 130 and the pressure roller 150, it is easily pulled out from the rear cover side. When the front cover 23 is opened, the nip plate 130 is located in the third position where the nip plate 130 is spaced apart from the pressure roller 150. The jammed sheet P can be easily pulled out.

The transmission mechanism 151 that transmits a drive force of the motor M to the pressure roller 150 includes the one-way clutch 153. When the jammed sheet P is pulled out from the first opening 2A by opening the rear cover 24, the rotation of the pressure roller 150 is not transmitted to the motor M, thus the jammed sheet P can be easily pulled out.

The shaft 310, which is a part of the interlocking mechanism 300, is disposed in the fixing frame 210 of the fixing unit 100. Thus, there is no need to provide a mechanism for connecting the fixing unit 100 and the interlocking mechanism 300. Compared with a case where all parts of the interlocking mechanism 300 are disposed in the main body 2, this structure facilitates removing the fixing unit 100 from the main body 2 to check the nip pressure and operational condition, resulting in improved maintenance.

As the process unit 6 is disposed between the front cover 23 and the fixing unit 100, a distance from the front cover 23 to the fixing unit 100 is longer than a distance from the rear cover 24 to the fixing unit 100. Thus, it is harder to reach for and pull out the jammed sheet P from the front cover side than from the rear cover side. However, in this embodiment, when the front cover 23 is opened, the nip plate 130 is in the third position. Thus, even when the fixing unit 100 is farther from the front cover side, the jammed sheet P can be pulled out lightly and easily.

The interlocking mechanism 300 includes the first slide member 340 that is configured to transmit a force from the rear cover 24 to the first arm 331. Only by adjusting the size of the first slide member 340, the rear cover 24 can be freely positioned.

When the rear cover 24 is fully opened, the force applied from the pressure mechanism 200 via the first slide member 340 to the second cam 24C is directed to the rotation center 24A of the rear cover 24, which does not impart a rotational force to the rear cover 24. Thus, the opened rear cover 24 can be placed at rest.

When the front cover 23 is fully opened, a force applied from the pressure mechanism 200 via the second arm 332 to the second slide member 350 is directed in a direction perpendicular to the direction where the second slide member 350 moves, which does not impart a rotational force to the front cover 23. Thus, the opened front cover 23 can be placed at rest.

The above illustrative embodiment shows, but is not limited to, that the pressure mechanism 200 movably supports the nip plate 130 relative to the pressure roller 150. For example, the pressure mechanism 200 may movably support the pressure roller 150 relative to the nip plate 130.

The above illustrative embodiment shows, but is not limited to, that the transmission mechanism 151 includes the one-way clutch 153. Instead of the one-way clutch 153, a pendulum gear can be used.

Figure 13:
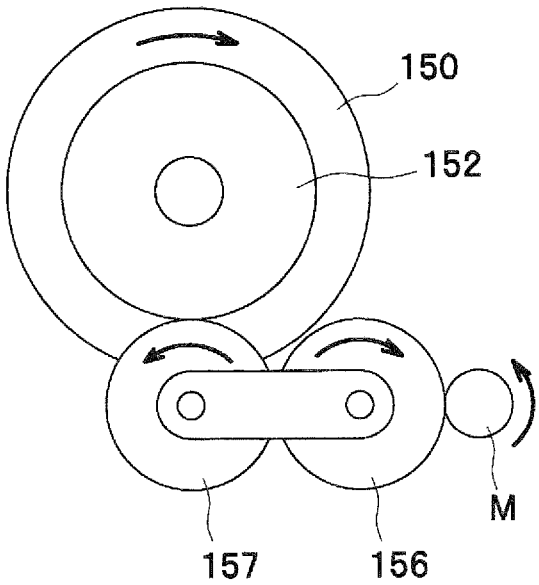
FIG. 13 illustrates a transmission mechanism according to another illustrative embodiment.

Specifically, as shown in FIG. 13, the pendulum gear includes a sun gear 156 that engages the motor M and a planetary gear 157 that engages the drive gear 152 and the sun gear 156 and whose rotation shaft is connected to a rotation shaft of the sun gear 156. In the fixing unit 100 including such a pendulum gear, when the drive force is transmitted from the motor M to the sun gear 156, it is transmitted via the planetary gear 157 to the drive gear 152, and the pressure roller 150 rotates. At this time, the planetary gear 157 is subjected to a force to rotate the sun gear 156. Thus, the planetary gear 157 is pressed to and engages the drive gear 152.

When the sheet P jammed between the nip plate 130 and the pressure roller 150 is being pulled out from the rear cover side, the pressure roller 150 rotates, and the drive gear 152 rotates and transmits a force to the planetary gear 157. The force acts in a direction where the planetary gear 157 moves away from the drive gear 152. As the force causes the drive gear 152 and the planetary gear 157 to be disengaged from each other, the rotation of the pressure roller 150 is not transmitted to the motor M, and thus the sheet P can be easily pulled out from the rear cover side.

The above illustrative embodiment shows, but is not limited to, the nip plate 130 being spaced apart from the pressure roller 150 when located in the third position. The nip plate 130 may contact the pressure roller 150 when it is in the third position. Even when the nip plate 130 contacts the pressure roller 150, if the nip pressure between the nip plate 130 and the pressure roller 150 is sufficiently weakened, a jammed sheet P can be easily pulled out.

The above illustrative embodiment shows, but is not limited to, the nip plate 130 as a heating member. As the heating member, a plate-shaped ceramic heater or a tubular heating roller may used. For the tubular heating roller, a driving force of the motor M may be inputted to the heating roller, not the pressure roller 150.

The above illustrative embodiment shows, but is not limited to, the pressure roller 150 as a backup member. For example, the backup member may include a belt-shaped pressing member.

The above illustrative embodiment shows, but is not limited to, that the second opening 2B is formed at a front wall of the main body 2. The second opening 2B may be formed in an upper wall of the main body 2. In other words, the second cover may be a top cover.

This illustrative embodiment shows, but is not limited to, the color printer 1 as an image forming apparatus. It will be appreciated that this illustrative embodiment also applies to other types of image forming apparatuses, such as an LED printer that performs exposing using LEDs. In addition, the image forming apparatus is not limited to a printer, but may be a copier or a multi-function apparatus.

This illustrative embodiment shows, but is not limited to, an image forming apparatus configured to form a monochrome image. The image forming apparatus may be configured to form a color image.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a fixing unit comprising:

a heating member configured to heat a recording medium;

a backup member configured to rotate and contact the heating member; and a pressure mechanism configured to support one of the heating member and the backup member such that the one of the heating member and the backup member is configured to move relative to the other of the heating member and the backup member;

a main body including the fixing unit inside, the main body having a first opening and a second opening, the first opening being formed on a downstream side of the fixing unit in a medium feeding direction, the second opening being formed on a side of the main body different from the first opening;

a first cover configured to open and close the first opening;

a second cover configured to open and close the second opening; and an interlocking mechanism configured to drive the pressure mechanism to:

move, in conjunction with opening of the first cover when the second cover is closed, the one of the heating member and the backup member from a first position where the one of the heating member and the backup member is pressed into contact with the other of the heating member and the backup member to a second position where the one of the heating member and the backup member remains in contact with the other of the heating member and the backup member and is away from the other of the heating member and the backup member relative to the first position, wherein the interlocking mechanism is engaged with the first cover when the first cover is open and the second cover is closed; and move, in conjunction with opening of the second cover when the first cover is closed, the one of the heating member and the backup member from the first position, where the one of the heating member and the backup member is pressed into contact with the other of the heating member and the backup member, to a third position where the one of the heating member and the backup member is separated away from the other of the heating member and the backup member, wherein the interlocking mechanism includes:

a shaft supported by the fixing unit;

a first cam configured to rotate about the shaft and act on the pressure mechanism;

a first link mechanism coupled to the first cover;

a second link mechanism coupled to the second cover; and a pivotable member configured to pivot about the shaft and including both of a first force receiving portion and a second force receiving portion, the first force receiving portion being configured to receive a force from the first link mechanism to transmit the force received from the first link mechanism to the first cam such that the pivotable member pivots about the shaft in conjunction with opening of the first cover to drive the pressure mechanism to move the one of the heating member and the backup member from the first position where the one of the heating member and the backup member is pressed into contact with the other of the heating member and the backup member to the second position where the one of the heating member and the backup member remains in contact with the other of the heating member and the backup member and is away from the other of the heating member and the backup member relative to the first position, the second force receiving portion being configured to receive a force from the second link mechanism to transmit the force received from the second link mechanism to the first cam such that the pivotable member pivots about the shaft in conjunction with the second cover to drive the pressure mechanism to move the one of the heating member and the backup member from the first position to the third position where the one of the heating member and the backup member is separated away from the other of the heating member and the backup member.

2. The image forming apparatus according to claim 1, further comprising:

a drive source configured to supply a drive force to the one of the heating member and the backup member; and a transmission mechanism configured to transmit the driving force of the drive source to the one of the heating member and the backup member, wherein the transmission mechanism is configured to interrupt transmission of rotation of the one of the heating member and the backup member to the drive source, the rotation of the one of the heating member and the backup member being produced when the recording medium is pulled to the downstream side of the fixing unit in the medium feeding direction.

3. The image forming apparatus according to claim 1, wherein the fixing unit is detachably attached to the main body, and wherein a part of the interlocking mechanism is disposed in the fixing unit.

4. The image forming apparatus according to claim 1, further comprising a process unit disposed in the main body, wherein the process unit is disposed between the second cover and the fixing unit.

5. The image forming apparatus according to claim 1, wherein the first link mechanism of the interlocking mechanism includes a first slide member configured to transmit the force from the first cover to the first force receiving portion of the pivotable member.

6. The image forming apparatus according to claim 5, wherein the first cover includes a second cam configured to convert a rotating motion of the first cover into a sliding motion of the first slide member; and wherein, when the first cover is opened, a force applied from the pressure mechanism via the first slide member to the second cam is directed to a rotation center of the first cover.

7. The image forming apparatus according to claim 1, wherein the second link mechanism of the interlocking mechanism includes a second slide member configured to transmit the force from the second cover to the second force receiving portion of the pivotable member, and wherein, when the second cover is opened, a force applied from the pressure mechanism via the second force receiving portion to the second slide member is directed in a direction perpendicular to a direction in which the second slide member moves.

8. The image forming apparatus according to claim 1, wherein the interlocking mechanism is configured to cause the pressure mechanism to move the heating member.

9. The image forming apparatus according to claim 1, wherein the heating member is one of a nip plate, a plate-shaped heater and a tubular heating roller.

10. The image forming apparatus according to claim 1, wherein the backup member is one of a pressure roller and a belt shaped pressing member.

11. The image forming apparatus according to claim 1, wherein the second opening is formed on an upstream side of the fixing unit.

12. The image forming apparatus according to claim 1, wherein the pivotable member of the interlocking mechanism includes:

a first arm extending from the shaft and including the first force receiving portion; and a second arm extending from the shaft and including the second force receiving portion.

13. The image forming apparatus according to claim 12, wherein the first arm and the second arm are integrally formed.

14. The image forming apparatus according to claim 1, wherein, when the first cover and the second cover are closed, the pivotable member is spaced apart from the second link mechanism.

15. The image forming apparatus according to claim 1, wherein, when the first cover and the second cover are closed, the second link mechanism extends in a direction crossing the pivotable member.

16. The image forming apparatus according to claim 1, wherein, when the first cover and the second cover are closed, the one of the heating member and the backup member is in the first position.

17. The image forming apparatus according to claim 1, wherein, when the first cover is opened and the second cover is closed, the one of the heating member and the backup member is in the second position.

18. The image forming apparatus according to claim 1, wherein, when the first cover is opened and the second cover is closed, the first force receiving portion of the pivotable member is in contact with the first link mechanism.

19. The image forming apparatus according to claim 1, wherein, when the second cover is opened and the first cover is closed, the one of the heating member and the backup member is in the third position.

20. The image forming apparatus according to claim 1, wherein, when the second cover is opened and the first cover is closed, the second force receiving portion of the pivotable member is in contact with the second link mechanism.

* * * * *